United States Patent [19]

Leroy et al.

[11] Patent Number: 4,903,512

[45] Date of Patent: Feb. 27, 1990

[54] LOCK OF THE DISCONNECTABLE ROTOR TYPE

[75] Inventors: Jean Leroy, La Queue les Yvelines; Jean-Pierre Bosdevesy, Cergy, both of France

[73] Assignee: Neiman, Croissy, France

[21] Appl. No.: 345,708

[22] Filed: May 1, 1989

[30] Foreign Application Priority Data

May 4, 1988 [FR] France ..... 88 05970

[51] Int. Cl.[4] ..... E05B 17/04

[52] U.S. Cl. ..... 70/379 R; 70/360; 70/380

[58] Field of Search ..... 70/360, 379 R, 380, 70/417, 418, 419, 421, 422

[56] References Cited

U.S. PATENT DOCUMENTS

| | | | |
|---|---|---|---|
| 3,659,444 | 5/1972 | Wellekens | 70/360 |
| 4,027,509 | 6/1977 | Funk | 70/379 R |
| 4,530,223 | 7/1985 | Oliver | 70/417 |
| 4,759,204 | 7/1988 | Neyret | 70/360 |
| 4,761,976 | 8/1988 | Kleinlany | 70/380 |

FOREIGN PATENT DOCUMENTS

| | | |
|---|---|---|
| 151081 | 8/1985 | European Pat. Off. . |
| 212468 | 3/1987 | European Pat. Off. . |
| 2583813 | 12/1986 | France . |
| 2005335 | 4/1979 | United Kingdom . |

*Primary Examiner*—Robert L. Wolfe

*Attorney, Agent, or Firm*—Wenderoth, Lind & Ponack

[57] ABSTRACT

A lock of the disconnectable rotor type comprises a rotor rotatable in a stator sleeve rotatable in a fixed lock case. Locking means (e.g. pairs of pins or pallets) cooperate with rotor and stator sleeve to couple them together for simultaneous rotation in the absence of a correct key while freeing the rotor from the stator sleeve when the correct key is introduced. The stator sleeve is maintained in a normal or "rest" position by an effaceable indexing member. The indexing member cooperates with the lock case to maintain the stator sleeve in its said position. A lock bolt actuating lever is coupled to the rotor by coupling means such as to effect this coupling only after rotation of the rotor independently of the stator sleeve. The coupling means include a slide ring rotatable with the rotor, cooperating with the stator sleeve through camming means to slide the slide ring axially, and including at least one actuating finger. After the slide ring has thus moved axially, the fingers enter holes in the bolt actuating lever, the slide ring being biassed towards the rotor by means of a return spring. If any attempt is made to force the lock by rotation of the rotor, the stator sleeve rotates with the rotor because of the locking pins, and the slide ring is then not displaced axially since the sleeve cannot rotate. The finger then cannot operate the bolt lever.

7 Claims, 2 Drawing Sheets

LOCK OF THE DISCONNECTABLE ROTOR TYPE

FIELD OF THE INVENTION

This invention relates to a lock of the disconnectable rotor type, comprising a rotor which is rotatable in an intermediate stator sleeve, the latter being itself pivotally rotatable in a fixed body or case of the lock. In this type of lock, locking means such as pairs of pins or pallets cooperate with the rotor and the stator sleeve so as to couple them together for simultaneous rotation, either in the absence of a key or in the presence of an incorrect key, while acting to free the rotor from the stator sleeve when the correct key has been introduced. The stator sleeve is maintained in a normal or "rest" position by means of an indexing member which is effaceable, i.e. it can be moved to a position where it does not interfere with rotation of the rotor. The indexing member cooperates with the lock case to maintain the stator sleeve in its said position. The lock further comprises an actuating member for a lock bolt, for example a lever or tumbler, together with coupling means, coupling the rotor with the said bolt actuating member, so arranged as to effect this coupling only after rotation of the rotor independently of the stator sleeve.

BACKGROUND OF THE INVENTION

Such disconnectable rotor locks have the significant advantage from the security point of view that they cannot be forced by rotation, since forcible rotation acts on the sleeve, or intermediate stator (which remains secured with respect to the rotor by the locking means), in such a way that the above mentioned coupling means cannot be activated, so that the bolt actuating member for the lock bolt is also not operated. Similarly, such locks are difficult to open by axial penetration into the lock mechanism, such as an attempt to make a sectional cut in order to try to reach the locking means, since the piercing tool tends to cause the rotor, and the stator sleeve with it, to rotate in such a way that, again, the bolt actuating member will not operate.

A lock of the above mentioned kind is described for example in European Patent Publication EP 0 151 081A. The lock described in that publication includes coupling means, coupling the rotor to a bolt actuating member, which comprise a finger coupled for rotation with the rotor, the axis of rotation of this finger being normally coaxial with that of the rotor but being capable of being displaced off centre only when the rotor rotates by itself.

Such a lock does however have various disadvantages. In particular, its construction is complicated and cumbersome, which makes it difficult to use in practice when the lock is required to be economical and to occupy a small volume.

It has also been proposed to make the rotor, or part of the rotor, slideable with respect to the stator sleeve when, but only when, the correct key is inserted, in such a way that the rotor engages with the bolt actuating member after this sliding movement. Such a lock, apart from the considerable length which it must have to allow the rotor to slide, has the disadvantage that it is subject to substantial wear because of the sliding action of the rotor, with all or part of the locking means, every time the bolt is opened or closed. In addition, it requires very high precision in the locking members (constituting the locking means) themselves, and a very small clearance between the rotor and the stator sleeve in order to satisfy the requirements of security.

SUMMARY OF THE INVENTION

An object of the present invention is to provide a novel lock, of the kind described under "Field of the Invention" above, which does not have the disadvantages of the known locks of this type, while being also of simple, economical and reliable construction.

According to the invention, in a lock of the said kind, the coupling means include a slide ring which is coupled with the rotor for rotation therewith and which cooperates with the stator sleeve through camming means, the said slide ring including at least one actuating finger which comes into engagement, after the slide ring has undergone sliding movement due to its cooperation through the camming means with the stator sleeve, with aperture means formed in the bolt actuating member, the slide ring being biassed towards the rotor by means of a return spring. If any attempt is made to force the lock by rotation of the rotor, the stator sleeve is caused to rotate with the rotor, because these two members are coupled together by the locking means, and the slide ring is then not displaced axially through its camming cooperation with the stator sleeve, since the latter is secured against rotation with respect to the slide ring. The actuating finger or fingers of the cam cannot then come into engagement with the bolt actuating member, so that as a result, the latter cannot operate.

In one preferred embodiment of the invention, the said slide ring engages against a stop member which is slideable in the lock case and also partially in the bolt actuating member. In the absence of the correct key, the stop member locks the bolt actuating member with respect to the case in such a way that the bolt actuating member cannot be activated separately so as to open the bolt. In this case, according to another feature of the invention, the return spring of the slide ring engages on the said stop member.

Preferably, the lock includes means mounting the indexing member on the stator sleeve for rotation therewith, the indexing member comprising a lever having a laterally projecting claw and a projection extending laterally in the opposite direction from said claw, the lock further comprising spring means urging the said lever into contact with the lock case, the lock case having a longitudinal groove with chamfered edges, so disposed that the said claw engages therein when the lock is in its normal or rest position, and the rotor having a slot so disposed as to be facing the said projection of the indexing member when the lock is in the said rest position.

In normal operation, the pressure of the indexing lever against the lock case, under the action of the lever spring means, sets up a frictional reaction torque which ensures correct indexing between the stator sleeve and the lock case. Once the rotor has begun to rotate by itself, the projection which is part of the indexing lever no longer lies facing the slot in the rotor, so that the lever can no longer engage it. By contrast, in the absence of the correct key, the stator sleeve rotates with the rotor because of the locking means such as pins or pallets. The claw of the indexing lever is raised up by its engagement with a chamfered edge of the longitudinal groove formed in the lock case, so that the projection on the other side of the lever enters the slot in the rotor, and this strengthens the coupling together of the stator sleeve and the rotor, positively preventing rotation of the rotor.

In order to compensate for the angular movement which the rotor must carry out in order to return to the "rest" position (which is the position for extraction of the key), since it is not always possible to ensure that this return will take place simply by operation of the camming means, a further preferred feature of the invention provides that the rotor is returned by a second return spring to the rest position. This return spring acts once the rotor has rotated through a predetermined angle. In one embodiment, the rotor, or second, return spring is a torsion spring. Preferably, however, it comprises at least one leaf spring cooperating with a flat surface formed on the rotor.

It is also possible to provide, in known manner, a hardened protective ring around the entrance to the keyway of the rotor in order to improve the security of the lock.

The invention will be better understood from a reading of the description which follows, and which is given by way of example only and with reference to the accompanying drawings.

DESCRIPTION OF A PREFERRED EMBODIMENT

Figure 1:
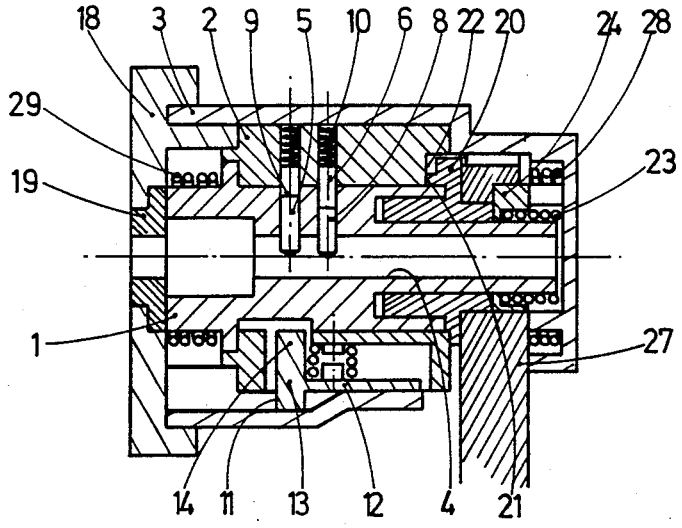
FIG. 1 is a simplified view in axial cross section of a lock in one embodiment of the invention with the key removed.

The lock comprises a rotor 1 which is rotatable in a coaxial intermediate stator sleeve 2, which is rotatable in a fixed body or case 3 of the lock. The rotor 1 has a longitudinal keyway 4 and is provided with radial bores 5 which open into the keyway 4. The sleeve 2 has radial bores 6, which form longitudinal extensions of the bores 4 of the rotor when the lock is in its normal or "rest" position, as shown in FIG. 1, ready for insertion or removal of the correct key 7.

Figure 2:
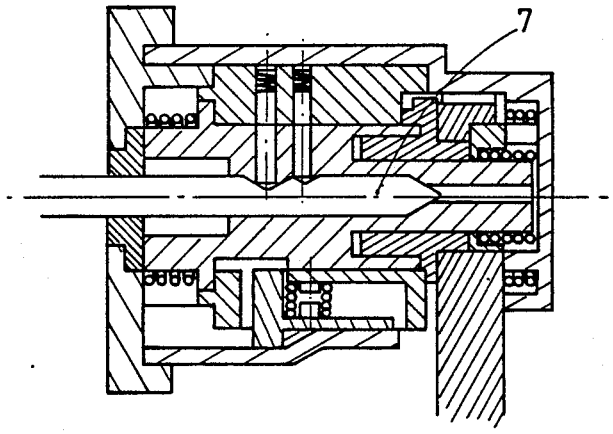
FIG. 2 is similar to FIG. 1, but with the appropriate key in position after being initially introduced.

The lock includes locking means, here in the form of pairs of locking pins, each pair comprising a rotor pin 8 and a stator pin 9, with each pair of pins 8, 9 being biassed by a spring 10 and being slideable in end to end alignment in the bores 5 and 6. In the absence of the key 7, i.e. as shown in FIG. 1, the point of contact between each stator pin 9 and its associated rotor pin 8 does not coincide with the outer periphery of the rotor 1, so that the latter is locked by the pins against movement with respect to the intermediate stator sleeve 2. However, after the correct key 7 has been introduced (FIGS. 2 and 3), the point of contact of the pins 8 and 9 of each pair is aligned with the periphery of the rotor, so that the latter is unlocked and becomes rotatable with respect to the sleeve 2.

The locking means comprising the pins 8 and 9 may of course be replaced by any other known type of locking means, for example pallets, levers etc.

Figure 4:
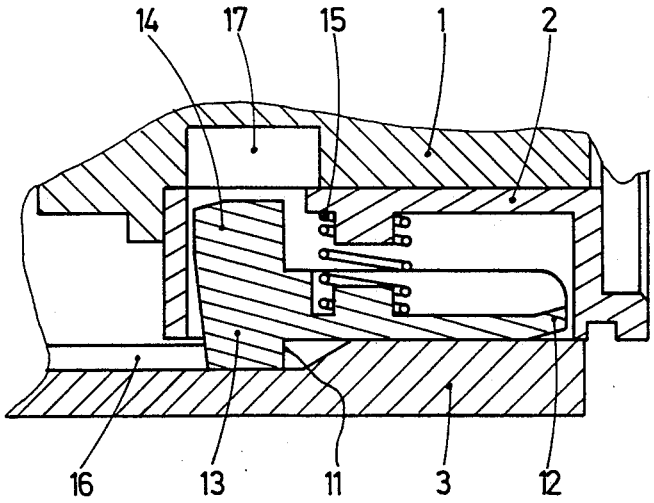
FIG. 4 is a view in cross section, on a larger scale, showing an indexing lever.
Figure 5:
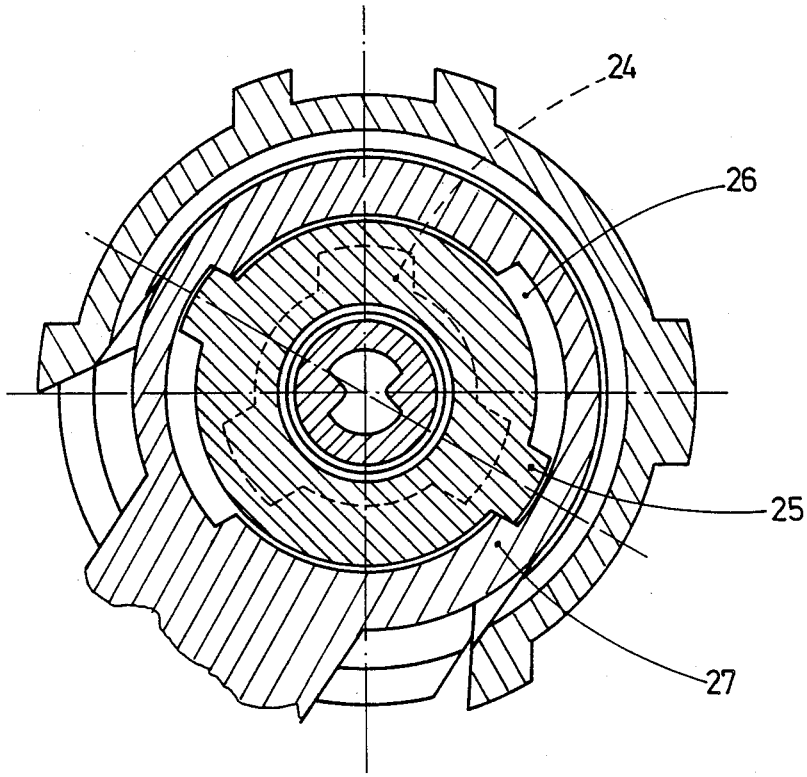
FIG. 5 is a view in cross section taken along the line V—V in FIG. 3, but on a larger scale than the latter.

The sleeve 2 is indexed into its position corresponding to the rest or normal position of the lock by means of an indexing member 11 shown in FIG. 4. In this example, the indexing member 11 comprises a lever 12 which is housed within the sleeve 2 and which has, projecting laterally from one end, a claw 13 and a projection 14 extending in the opposite direction to the claw 13. The lever 12 is biassed by a spring 15 into contact with the lock case 3, with the claw 13 then being engaged in a longitudinal groove 16 formed in the case 3. The edges of the groove 16 are chamfered. The projection 14 of the lever 12 lies facing a slot 17 formed in the rotor 1.

In normal operation, the force exerted by the lever 12 on the case 3 ensures the required indexation between the intermediate stator sleeve 2 and the case 3. However, if forced rotation of the rotor 1 takes place, so tending to rotate the sleeve 2 by means of the locking pins 8 and 9, then the claw 13 of the lever 12 is raised by one of the chamfered edges of the slot 16, compressing the spring 15 and forcing the right hand part of the lever 12 more firmly against the case 3. At the same time, the projection 14 enters the slot 17. This reinforces the locking effect as between the rotor 1 and the sleeve 2. In normal operation, however, once the rotor 1 has rotated with respect to the sleeve 2 (FIG. 3), the slot 17 is no longer aligned with the projection 14 and the lever 12 is no longer able to rise.

The indexing member 11 may of course be replaced by any suitable equivalent device, for example a spring loaded ball.

A front plate 18 closes the open end of the rotor 1, and may carry a hardened insert 19. The latter, if provided, is fixed to the front plate 18 and protects the rotor 1 against unauthorised access from the front by piercing of the front plate. The insert 19 may alternatively be fixed to the rotor 1 itself, or may be free. A slide ring 20, which is coupled with the rotor 1 for rotation therewith, is slidingly mounted on the latter. The slide ring 20 has a cam or ramp profile 21 which cooperates with the rear surface 22 of the intermediate stator sleeve 2, in such a way as to cause the slide ring 20 to be displaced towards the right, as seen in the drawings, when the rotor 1 is rotated with respect to the sleeve 2. By contrast, when the sleeve 2 rotates with the rotor 1, as will happen during any attempt to break open the lock, the slide ring 20 is secured against this axial movement.

Figure 3:
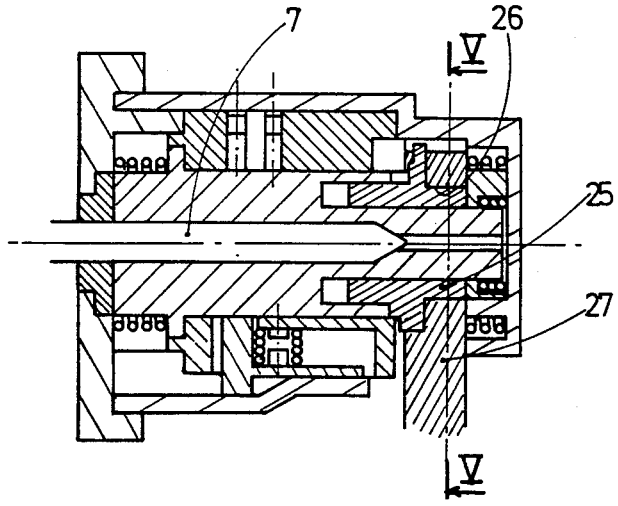
FIG. 3 is similar to FIG. 2, and shows the lock after the key has been used to rotate the rotor.

The slide ring 20 is under the influence of a compression-type return spring 23, which acts on it through a slide member 24. The latter is not rotatable with respect to the case 3. The slide ring 20 is provided with slide fingers 25 which, in the normal position of the lock shown in FIGS. 1 and 2, lie outside aperture means 26, comprising a set of through holes, which are formed in a bolt actuating lever 27 (FIG. 3). The member 24, in the normal position of the lock, penetrates partially into the lever 27, so as to immobilise the latter.

After introduction of the correct key 7 (FIGS. 2 and 4) and rotation of the rotor 1 through a predetermined angle, for example 30°, the actuating fingers 25 will have penetrated into the holes 26 of the bolt actuating lever 27, as a result of the sliding movement of the slide ring 20. This sliding movement produces a displacement of the slide member 24 in the same direction against the action of the return spring 23. The bolt actuating lever 27 is thus freed with respect to the lock case 3 and becomes coupled with the rotor 1 so as to be rotatable with it (FIG. 3).

A torsion spring 28 acts conventionally to return the lever 27 into an equilibrium position.

In order to return the lock to the "rest" position in which the key can be removed, if the spring 23 is not sufficient to return the members 24 and 20 to the release position shown in FIG. 1, due to friction between the ramp surface 21 and the sleeve 2, the rotor 1 may be provided with a return spring to enable it to pass through the necessary angle of rotation to return to that position. For this purpose, a torsion spring 29 (FIGS. 1 to 3) may be used. Alternatively, and preferably, one or more leaf springs may be used cooperating with one or more flat surfaces formed on the rotor 1.

What is claimed is:

1. A lock of the disconnectable rotor type, comprising a case or body, an intermediate stator sleeve mounted rotatably in said case, a rotor mounted rotatably in the said intermediate stator sleeve, locking means (such as pairs of locking pins or pallets), means mounting the said locking means for cooperation with the rotor and the stator sleeve whereby to couple the rotor and stator sleeve for rotation together in the absence of a key or in the presence of an incorrect key, and whereby further to free the rotor from the stator sleeve upon introduction of a correct key, an indexing member mounted effaceably within the case for cooperation with the said case and the stator sleeve whereby to hold the stator sleeve in a predetermined normal or rest position, the lock further comprising a bolt actuating member (such as a lever or tumbler) and coupling means, for coupling the said rotor with the bolt actuating member in such a way as to couple them together only after rotation of the rotor independently of the stator sleeve, wherein the said coupling means comprise a slide ring, means coupling the slide ring with the rotor for rotation therewith, camming means on the said slide ring and stator sleeve for effecting cooperation between the slide ring and stator sleeve, and first return spring means urging the slide ring towards the rotor, the slide ring comprising at least one actuating finger and the bolt actuating member having aperture means, such that the slide member can slide with respect to the rotor in response to its cooperation with the stator sleeve through the camming means, whereby to engage the said actuating finger or fingers in the aperture means of the bolt actuating member.

2. A lock according to claim 1, further comprising a stop member mounted slideably in the lock case and partially in the bolt actuating member, the slide ring being in abutting engagement with the stop member.

3. A lock according to claim 2, wherein the return spring means for the slide ring engages on the stop member.

4. A lock according to claim 1, including means mounting the indexing member on the stator sleeve for rotation therewith, the indexing member comprising a lever having a laterally projecting claw and a projection extending laterally in the opposite direction from said claw, the lock further comprising spring means urging the said lever into contact with the lock case, the lock case having a longitudinal groove with chamfered edges, so disposed that the said claw engages therein when the lock is in its normal or rest position, and the rotor having a slot so disposed as to be facing the said projection of the indexing member when the lock is in the said rest position.

5. A lock according to claim 4, further comprising second return spring means engaging the rotor so as to return the rotor to the position corresponding to the said rest position, the second return spring means being arranged to act when the rotor has turned through a predetermined angle.

6. A lock according to claim 5, wherein the second return spring means is a torsion spring.

7. A lock according to claim 5, wherein the second return spring means comprises at least one leaf spring cooperating with a flat surface formed on the rotor.

* * * * *